US009168406B2

(12) United States Patent
Chaney et al.

(10) Patent No.: US 9,168,406 B2
(45) Date of Patent: Oct. 27, 2015

(54) AUTOMATIC ACTUATION OF A GENERAL PURPOSE HAND EXTINGUISHER

(75) Inventors: Marcus Chaney, Wilson, NC (US); Patrick Lofvenholm, Raleigh, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 736 days.

(21) Appl. No.: 13/421,568

(22) Filed: Mar. 15, 2012

(65) Prior Publication Data

US 2013/0240221 A1 Sep. 19, 2013

(51) Int. Cl.

| | |
|---|---|
| ***A62C 13/62*** | (2006.01) |
| ***A62C 13/64*** | (2006.01) |
| ***A62C 35/02*** | (2006.01) |
| ***A62C 35/13*** | (2006.01) |

(52) U.S. Cl.

CPC ..... *A62C 35/13* (2013.01); *A62C 13/62* (2013.01); *A62C 13/64* (2013.01); *A62C 35/023* (2013.01)

(58) Field of Classification Search

CPC ..... A62C 13/62; A62C 13/64; A62C 35/023; A62C 35/13

USPC ..... 169/19, 20, 26, 46, 62, 74, 75, 89; 251/74, 319

See application file for complete search history.

(56) References Cited

U.S. PATENT DOCUMENTS

| | | | | |
|---|---|---|---|---|
| 3,529,670 | A | 9/1970 | Herbline | |
| 3,702,623 | A * | 11/1972 | Chacko | 137/495 |
| 3,889,752 | A | 6/1975 | Dunn | |
| 3,889,758 | A | 6/1975 | Dunn | |
| 4,159,744 | A | 7/1979 | Monte et al. | |
| 4,194,571 | A | 3/1980 | Monte | |
| 4,296,817 | A | 10/1981 | Monte | |
| 4,579,315 | A | 4/1986 | Kowalski | |
| 4,589,496 | A * | 5/1986 | Roznieck | 169/20 |
| 4,813,487 | A * | 3/1989 | Mikulec et al. | 169/65 |
| 5,009,249 | A * | 4/1991 | Fisher et al. | 137/495 |
| 5,063,998 | A * | 11/1991 | Quinn | 169/65 |
| 5,169,119 | A * | 12/1992 | Duggal et al. | 251/74 |
| 5,609,210 | A | 3/1997 | Galbraith et al. | |
| 5,808,541 | A | 9/1998 | Golden | |
| 5,996,699 | A | 12/1999 | Sundholm | |
| 6,019,177 | A | 2/2000 | Olander | |
| 6,702,033 | B1 | 3/2004 | Mitchell et al. | |

(Continued)

FOREIGN PATENT DOCUMENTS

| | | |
|---|---|---|
| CN | 101208136 A | 6/2008 |
| CN | 101626812 A | 1/2010 |

(Continued)

OTHER PUBLICATIONS

Japanese Office Action for application No. JP 2013050607, with translation, mailed Feb. 6, 2014, 6 pages.

(Continued)

*Primary Examiner* — Ryan Reis
(74) *Attorney, Agent, or Firm* — Cantor Colburn LLP

(57) ABSTRACT

An automatic fire extinguisher valve assembly includes a valve body, a push rod disposed in the valve body, a poppet stem arranged perpendicular to the push rod and disposed in the valve body, a poppet-to-valve body seal coupled to the poppet stem and disposed in the valve body and a poppet return spring coupled to the poppet stem and disposed in the valve body, wherein the push rod is configured to engage the poppet stem to open the poppet-to-valve body seal.

17 Claims, 7 Drawing Sheets

(56) References Cited

U.S. PATENT DOCUMENTS

| | | | | |
|---|---|---|---|---|
| 7,303,024 | B2 * | 12/2007 | Mikulec | 169/65 |
| 2002/0023967 | A1 | 2/2002 | Wolfe | |
| 2006/0278412 | A1 | 12/2006 | Hodges et al. | |

FOREIGN PATENT DOCUMENTS

| | | | |
|---|---|---|---|
| GB | 2233226 | A | 1/1991 |
| GB | 2255015 | A | 10/1992 |
| JP | S31009451 | U | 6/1956 |
| JP | S4924333 | U | 3/1974 |
| JP | S58086605 | U | 6/1983 |
| JP | 559191476 | U | 12/1984 |
| JP | H10047507 | A | 2/1998 |
| JP | 2008541937 | A | 11/2008 |
| JP | 2010517647 | A | 5/2010 |
| KR | 2020090001152 | U | 7/2007 |
| KR | 1020090049469 | A | 11/2007 |
| WO | 9315794 | A1 | 8/1993 |
| WO | 9526218 | A1 | 10/1995 |
| WO | 2006008436 | A1 | 1/2006 |

OTHER PUBLICATIONS

Korean Office Action for application No. KR 1020130027173, mailed Dec. 24, 2013, 5 pages.

Australian Office Action for application AU 2013201449, mailed Apr. 3, 2014, 6 pages.

Chinese Office Action issued Oct. 28, 2014 in corresponding U.S. Appl. No. 13/421,568.

* cited by examiner

AUTOMATIC ACTUATION OF A GENERAL PURPOSE HAND EXTINGUISHER

BACKGROUND OF THE INVENTION

The present invention relates to automatic fire extinguishing (AFE) systems, and more specifically, to systems and methods for dispersing extinguishing agents within a confined space.

AFE systems deploy after a fire or explosion event has been detected. In some cases, AFE systems are deployed within a confined space such as the crew or engine compartment of a military vehicle following an event. The AFE systems provide protection to some or all of the external features on a commercial or military vehicle following a fire or explosion event. The AFE systems are rapidly deployed as a high rate discharge after the event has been detected. Common means of detection used within the fire industry for these types of applications are high speed Infra-red (IR) and/or ultra violet (UV) sensors or thermal devices such as overheat cable and point thermal sensors. Other means such as melting pressurised tubes or measurement of acceleration levels have also been employed.

The AFE systems provide rapid detection and a high level of suppression efficacy against a wide range of fire and explosion events. However, such systems are costly. Conventional fire/explosion protection is provided on vehicles that may not be exposed to the level of threats for which existing systems have been specified. Such vehicles include vehicles or related events in which the crew are able to rapidly evacuate or have fast access to other fire fighting means. As such, other conventional vehicle extinguishing systems include lower cost system components that provide an adequate level of protection by employing slower detection and/or ways of extinguishing. These systems offer lower lifecycle costs for the user and often provide savings in weight and space as well.

BRIEF DESCRIPTION OF THE INVENTION

Exemplary embodiments include an automatic fire extinguisher valve assembly, including a valve body, a push rod disposed in the valve body, a poppet stem arranged perpendicular to the push rod and disposed in the valve body, a poppet-to-valve body seal coupled to the poppet stem and disposed in the valve body and a poppet return spring coupled to the poppet stem and disposed in the valve body, wherein the push rod is configured to engage the poppet stem to open the poppet-to-valve body seal.

Additional exemplary embodiments include an automatic fire extinguisher system, including a valve assembly, an actuator coupled to the valve assembly, a main outlet coupled to the valve assembly, a refill valve coupled to the valve assembly and a cylinder coupled to the valve assembly, wherein the actuator is configured to place the valve assembly and the cylinder in fluid communication.

Further exemplary embodiments include a method for operating an automatic fire extinguisher. The method includes detecting at least one of a fire or explosion in a confined space, and activating an automatic fire extinguisher. The automatic fire extinguisher includes a valve assembly including a valve body, an end stop disposed in the valve body, a push rod having an angled face and keyway disposed in the angled face, and disposed in the valve body, a poppet stem arranged perpendicular to the push rod and disposed in the valve body, a poppet-to-valve body seal coupled to the poppet stem and disposed in the valve body and a poppet return spring coupled to the poppet stem and disposed in the valve body, wherein the push rod is configured to engage the poppet stem to open the poppet-to-valve body seal. The automatic fire extinguisher further includes an actuator coupled to the valve assembly, a main outlet coupled to the valve assembly, a refill valve coupled to the valve assembly and a cylinder coupled to the valve assembly, wherein the actuator is configured to place the valve assembly and the cylinder in fluid communication in response to the at least one of the fire and explosion event. The method further includes securing the push rod.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
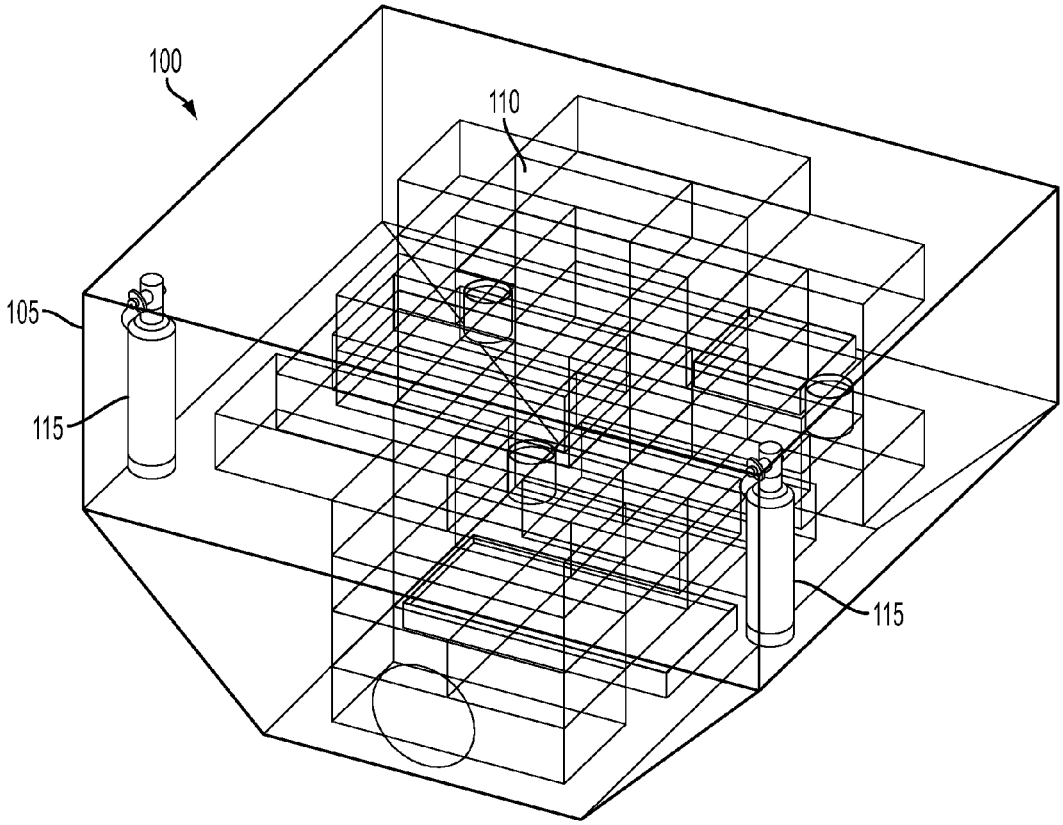
FIG. 1 diagrammatically illustrates an exemplary AFE system.

In exemplary embodiments, the systems and methods described herein include an AFE system that utilize standard components from residential and commercial (e.g., hand-held) fire extinguishers, modified to withstand the rugged environment of vehicle protection. FIG. 1 diagrammatically illustrates an exemplary AFE system 100. The system 100 includes an engine compartment 105, with engine components 110. The system 100 further includes two exemplary modified fire extinguishers 115 positioned to disperse extinguishing agents directly into the engine compartment 105 and onto the engine components 110. In the example, the modified extinguishers 115 are 1.3 liter extinguishers. It can be appreciated that in other exemplary embodiments, the modified extinguishers 115 can have other volumes. As described further herein, the modified fire extinguishers 115 automatically disperse agents within the engine compartment 105 in response to a fire/explosion event. In the example, the modified extinguishers 115 are mounted and positioned directly in the engine compartment 105. As described herein, the exemplary modified extinguishers 115 can be implemented in a variety of other confined spaces.

Figure 2:
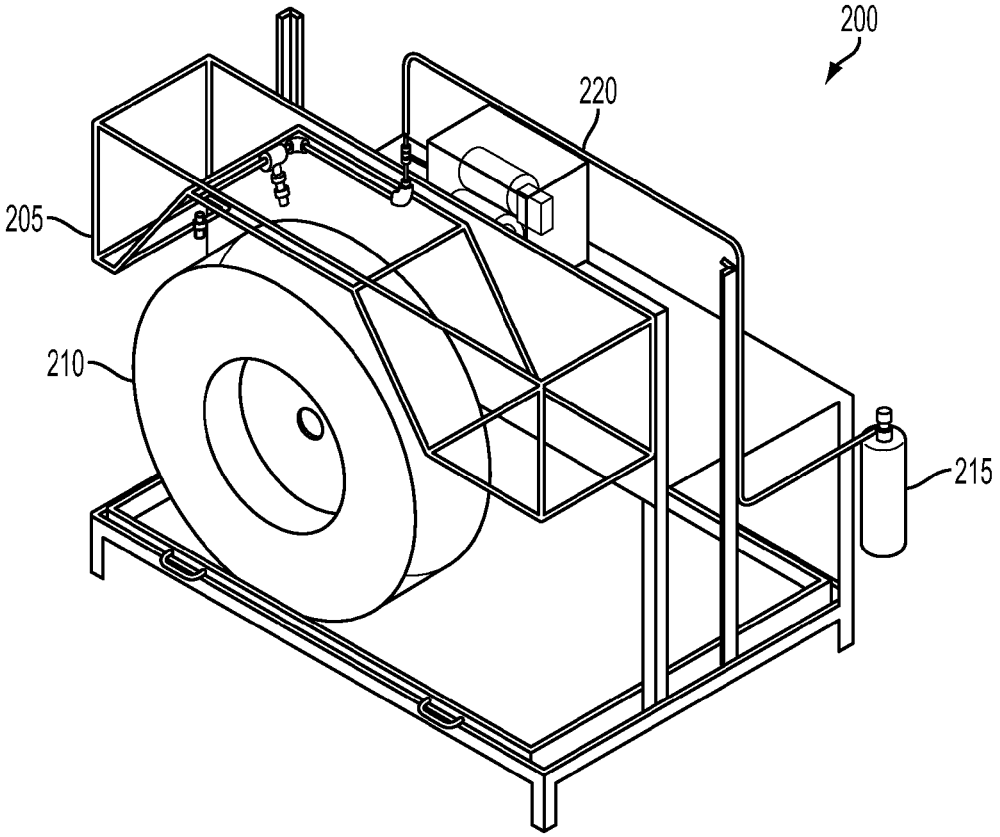
FIG. 2 diagrammatically illustrates another exemplary AFE system.

FIG. 2 diagrammatically illustrates another exemplary AFE system 200. The system 200 includes wheel bay 205 having a wheel 210. The system 200 further includes a modified fire extinguisher 215 positioned remotely from the wheel bay 205 and wheel 210 but including a pipe and nozzle network 220 to direct the extinguishing agents from the modified fire extinguisher 215 to the wheel bay 205 and wheel 210. In the example, the modified extinguisher 215 is a 5 liter extinguisher. It can be appreciated that in other exemplary embodiments, the modified extinguisher 215 can have other volumes. As described further herein, the modified fire extinguisher 215 automatically disperses agents within the wheel bay 205 in response to a fire/explosion event.

In the example, the modified extinguisher 215 is mounted remotely and the pipe and nozzle network 220 carries the extinguishing agents to the wheel bay. It will be appreciated that FIGS. 1 and 2 are examples and several other confined spaces are contemplated in other exemplary embodiments. As described herein, the exemplary modified extinguishers 115/215 can be implemented in a variety of other confined spaces.

As described herein the exemplary modified extinguishers (e.g., the modified extinguishers 115, 215) are primarily designed to employ common dry chemical fire extinguishing agents (e.g., Monnex fine grind) as the fire extinguishing agent. Other common dry chemical fire extinguishing agents (e.g. sodium bicarbonate, potassium bicarbonate) could be implemented. Water based agents could also be implemented. Additives could include alkali salts (e.g. potassium bicarbonate, potassium acetate, potassium lactate etc.) or foams (e.g. AFFF). Gaseous extinguishing agents such as FM200, FE36 and Novec 1230 could also be implemented but care would be required if installing these systems within potentially hot environments as the maximum working pressure for the examples described herein (e.g., FIGS. 1 and 2) can be in the range of 195 psig (13.4 bar(g)). It will be appreciated that other higher pressures are contemplated in other embodiments. For example, 360 psig or 900 psig may be implemented in other exemplary embodiments.

Figure 3:
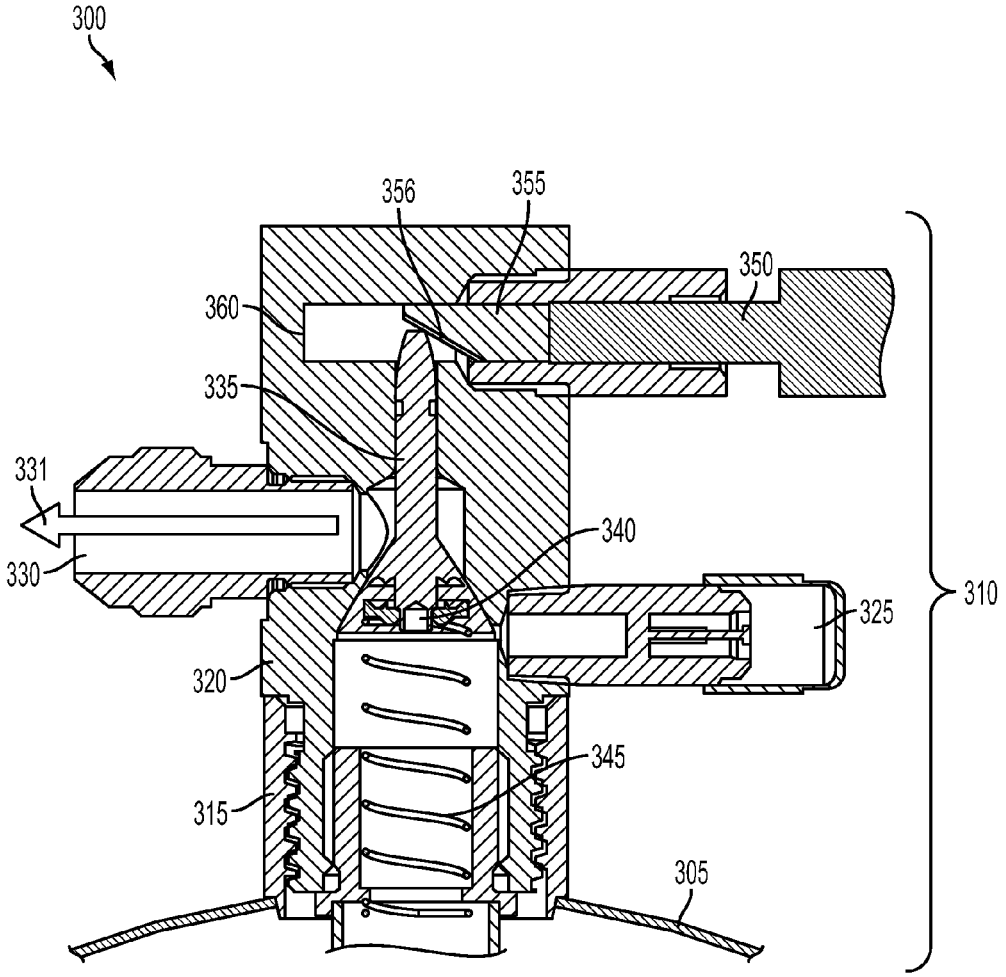
FIG. 3 illustrates an exemplary modified extinguisher.

In one embodiment, the modified extinguishers described herein include a valve that is automatically opened with an automatic actuator. The actuation devices open under harsh environments such as large changes and extremes of ambient temperature and vibration. FIG. 3 illustrates an exemplary modified extinguisher 300. This modified extinguisher 300 could be used, for example, as the extinguishers 115, 215, shown in FIGS. 1 and 2, respectively. The extinguisher 300 includes a cylinder 305 that stored the extinguishing agents, and a valve assembly 310 for dispersing the extinguishing agents. The valve assembly 310 includes a valve-to-cylinder adapter 315 that couples the cylinder 305 to the valve assembly 310. In one embodiment, the cylinder 305 can include a threaded opening that engages with corresponding threads on the valve-to-cylinder adapter 315. The valve assembly 310 further includes a valve body 320 coupled to the valve-to-cylinder adapter 315. The valve assembly 310 also includes a fill valve 325 disposed in the valve body 320 for re-filling the cylinder 305 with extinguishing agents. The valve assembly 310 further includes a main outlet 330 disposed in the valve body 320 and configured to disperse the extinguishing agents. In FIG. 3, arrow 331 indicates a direction of flow of the extinguishing agents. The valve assembly 310 also includes a poppet stem 335 disposed in the valve body 320. The poppet stem 335 is coupled to a poppet-to-valve body seal 340 that seals the extinguishing agents within the cylinder 305. The poppet stem 335 is configured to open the poppet-to-valve body seal 340 upon actuation as described further herein. The poppet stem 335 and the poppet-to-valve body seal 340 are disposed in the valve body 320. The valve assembly 310 also includes a poppet return spring 345 disposed in the valve body 320. The poppet return spring 345 and the pressure within the cylinder 305 retain the poppet stem 335 from opening the poppet-to-valve body seal 340 when the extinguisher is not actuated. The extinguisher 300 further includes an actuator 350 that is coupled to the valve body 320. The mode of operation of the actuator 350 is to rapidly eject a pin a short distance (e.g., between 6 mm and 15 mm) with a sufficient work output (e.g., between 4 J and 15 J) to push an actuation push rod 355 in a linear motion towards an end stop 360 within the valve body 320. This linear motion pushes an angled face 356 on the push rod 355, which forces the poppet stem 335 in a downwards direction with a force opposite a retention force of the poppet return spring 345 and pressure in the cylinder 305, releasing the poppet-to-valve body seal 340, creating fluid communication between the cylinder 305 and the main outlet 330, allowing extinguishing agent to flow from the main outlet 330. As such, it can be appreciated that the poppet stem 335 and the push rod 355 are arranged perpendicular (i.e., orthogonal) to one another. As described herein, the actuator 350 is activated by the sensing devices in the space in which the extinguisher 300 is positioned. Prior to pressurising the extinguisher 300 the poppet return spring 345 is used to return the poppet stem 335 to its closed position. Once pressurised the upwards force applied to the poppet stem 335 via the poppet return spring 345 is increased. It can be appreciated that actuation onto the push rod 355 can be achieved with other devices such as but not limited to a solenoid valve, a gas, or incompressible fluid. These other devices could be used to eject a pin directly or allow a flow of pressure, provided by either an external source or from within the extinguisher 300 itself, to apply the correct force to the push rod 355. The extinguisher 300 further includes an end stop 360 described further herein.

Figure 4:
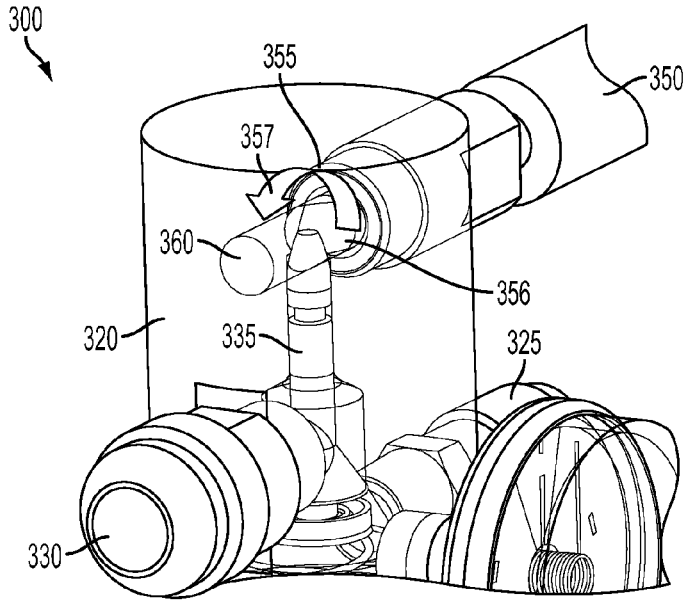
FIG. 4 illustrates a sectioned view of the push rod and other components of the extinguisher.

FIG. 4 illustrates a sectioned view of the push rod 355 and other components of the extinguisher 300. In one embodiment, the push rod 355 has a cylindrical cross section. As such, when the push rod 355 is actuated and the angled face 356 engages the poppet stem 335, it is possible that the push rod 355 will rotate as indicated by arrow 357 and affect the engagement with the poppet stem 335 during the sloped impact.

Figure 5:
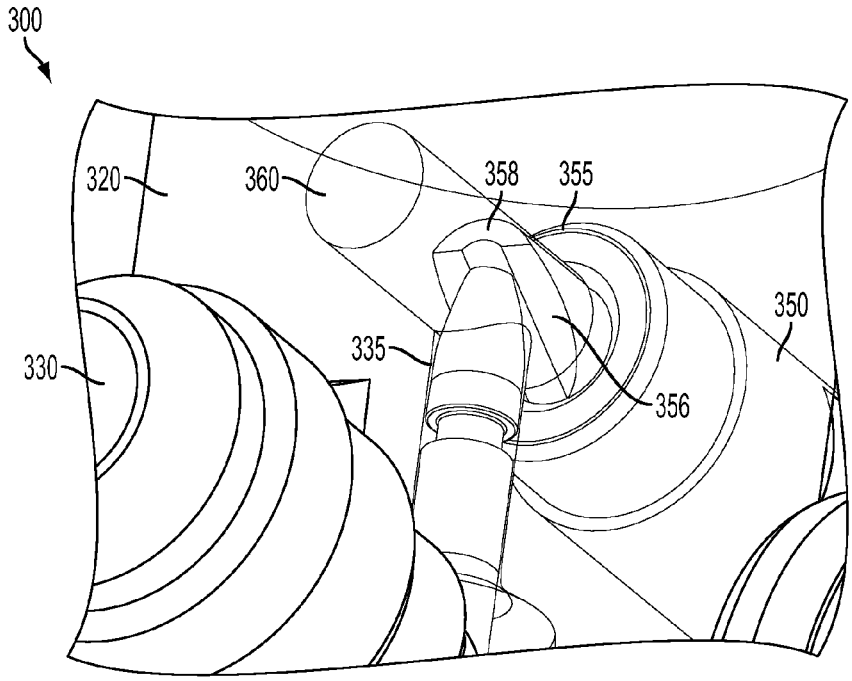
FIG. 5 illustrates another sectioned view of the push rod and other components of the extinguisher.

FIG. 5 illustrates another sectioned view of the push rod 355 and other components of the extinguisher 300. In one embodiment, the push rod 355 includes a keyway 358 machined in the angle face 356. The example in FIG. 5 illustrates the keyway 358 as a rounded profile, but other shapes could also be implemented in other embodiments. The keyway 358 keeps the poppet stem 335 centralized with respect to the push rod 355 at all times. In other embodiments, as described above, other shapes can be implemented other than round (e.g., square), or an externally minted keyway could be formed in the push rod 355.

In exemplary embodiments, upon actuation, linear motion of the push rod 355 as a result of the activation of the actuator 350 forces the poppet stem 335 along the keyway 358 until the poppet stem 335 reaches the thickest portion of the push rod 355. The push rod 355 continues its linear movement until the push rod 355 is near or impacts the end stop 360. As described herein, the poppet stem 335 opens the poppet-to-valve body seal 340 during the linear motion of the poppet stem 335. The linear motion of the push rod 355 is generally perpendicular to the linear motion of the poppet stem 335. The actuator 350 is an internally explosive electric device that, when activated pushes the pin against the push rod 355 as described herein. When activation is complete, the push rod 355 may tend to retract, which would allow the poppet return spring 345 to restore the poppet stem 335, thus closing the poppet-to-valve body seal 340.

Figure 6:
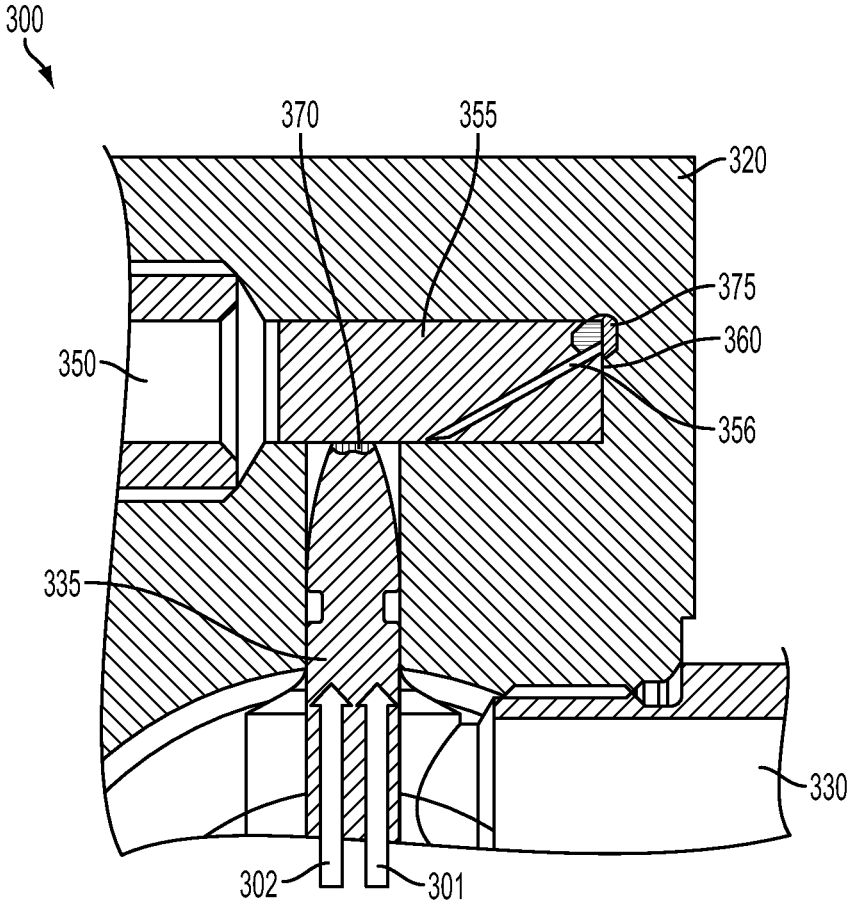
FIG. 6 illustrates a view of the fully actuated push rod in one embodiment.

FIG. 6 illustrates a view of the fully actuated push rod 355 in one embodiment. In this position, the poppet stem 335 is pushed against the poppet-to-valve body seal 340, thereby allowing the extinguishing agents to flow from the cylinder 305 to the main outlet 330. In addition, the push rod 355 impacts the end stop 360 and the poppet stem 335 rests against the push rod 355. As described herein, prior to actuation, the poppet stem 335 rests within the keyway 358. Linear motion of the push rod 355 is constrained by the actuator 350, such as by a spring within the actuator 350. As such, prior to actuation, the configuration limits any movement of components within the valve body 320 due to extremes in shock loads or vibration.

Upon actuation, the linear motion of the push rod 355 forces the poppet stem 335 along the keyway 358 until it reaches the outer diameter of the push rod 355. The push rod 355 continues the linear motion within the valve body 320 until finally impacting the end stop 360. As described herein, after the actuator 350 is activated, the push rod 355 may tend to retract. The actuator 350 may keep the push rod 355 extended, but this extension is not guaranteed. As such, the push rod 355 may retract, thereby allowing the poppet stem 335 to restore under the force 301 of the poppet return spring 345 (See FIG. 3) and the force 302 of the pressure of the extinguishing agents within the cylinder 305. In exemplary embodiments, the poppet stem 335 and the push rod 355 can be a material so that the action of the poppet stem 335 running along the keyway 358 provides a slight deformation 370 of the poppet stem profile and as such provides friction to prevent the push rod 355 from returning to its open position during the operation of the extinguisher 300. This extra friction is enhanced further by a slight deformation 375 of the push rod 355 as it reaches the end stop 360 within the valve body 320. FIG. 6 illustrates the extinguisher 300 highlighting the deformations 370, 375 on the poppet stem 335 and push rod 355, respectively, which prevents the poppet-to-valve body seal 340 from closing during operation.

Figure 7:
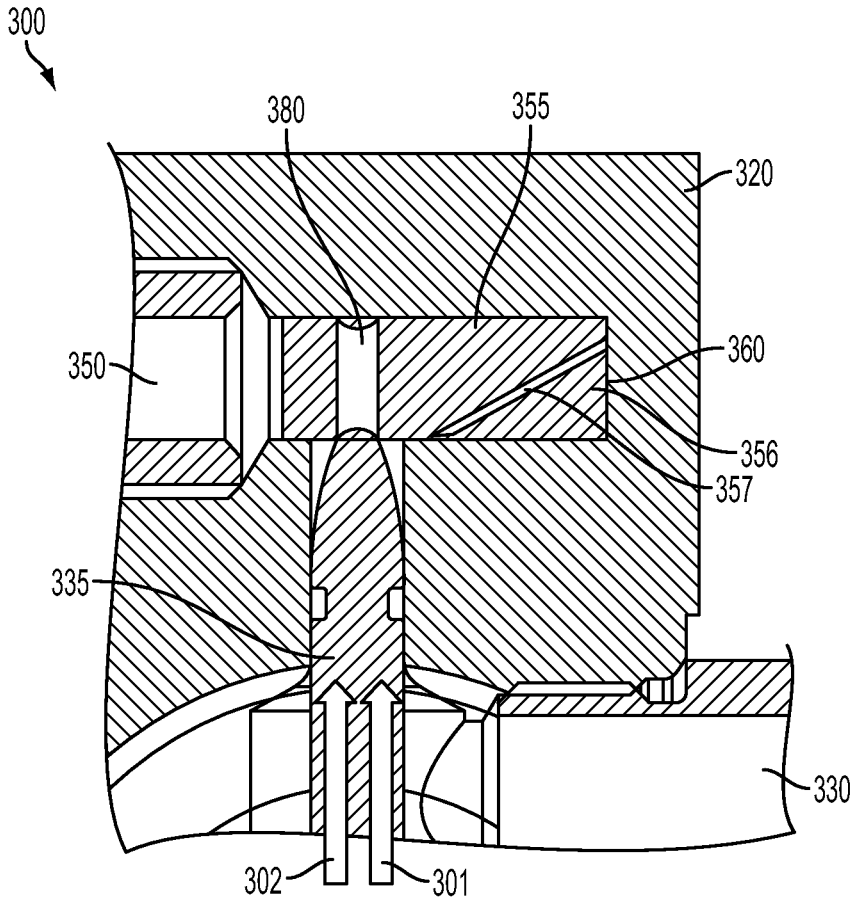
FIG. 7 illustrates a view of the fully actuated push rod in another embodiment.

FIG. 7 illustrates a view of the fully actuated push rod 355 in another embodiment. Similar to as described above, in this position, the poppet stem 335 is pushed against the poppet-to-valve body seal 340, thereby allowing the extinguishing agents to flow from the cylinder 305 to the main outlet 330. In addition, the push rod 355 impacts the end stop 360 and the poppet stem 335 rests against the push rod 355. As described herein, prior to actuation, the poppet stem 335 rests within the keyway 358. Linear motion of the push rod 355 is constrained by the actuator 350, such as by a spring within the actuator 350. As such, prior to actuation, the configuration limits any movement of components within the valve body 320 due to extremes in shock loads or vibration.

Upon actuation, the linear motion of the push rod 355 forces the poppet stem 335 along the keyway 358 until it reaches the outer diameter of the push rod 355. The push rod 355 continues the linear motion within the valve body 320 until finally impacting the end stop 360. As described herein, after the actuator 350 is activated, the push rod 355 may tend to retract. The actuator 350 may keep the push rod 355 extended, but this extension is not guaranteed. As such, the push rod 355 may retract, thereby allowing the poppet stem 335 to restore under the force 301 of the poppet return spring 345 (See FIG. 3) and the force 302 of the pressure of the extinguishing agents within the cylinder 305. In one embodiment, a groove 380 is machined into the push rod 355 which allows the poppet stem 335 to lock into position during the discharge. FIG. 7 illustrates the extinguisher 300 highlighting the groove 380 machined into the push rod 355, which prevents the poppet-to-valve body seal 340 from closing during operation.

Figure 8:
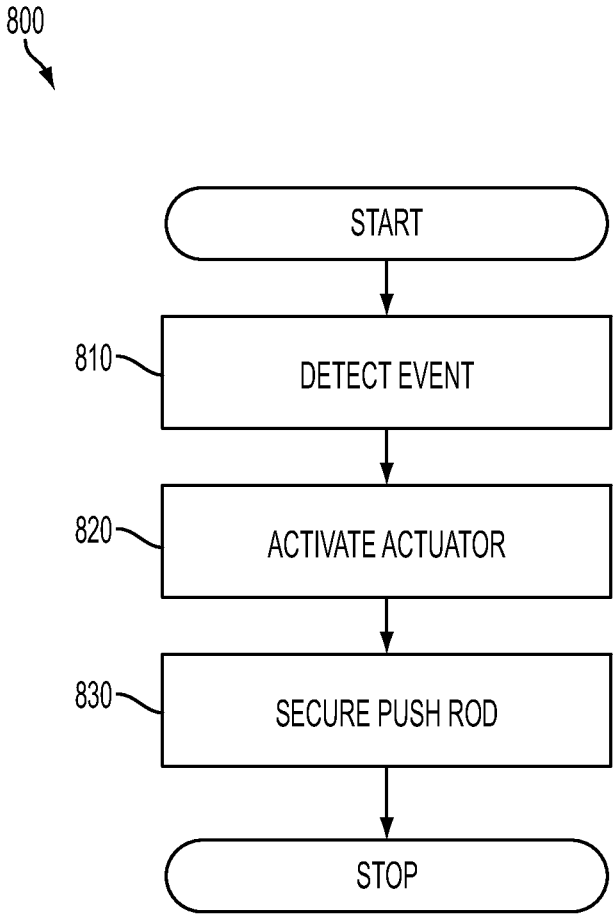
FIG. 8 illustrates a flow chart of a method for operating an exemplary AFE in accordance with exemplary embodiments.

FIG. 8 illustrates a flow chart of a method 800 for operating an exemplary AFE in accordance with exemplary embodiments. At block 810, detectors detect that there has been an event such as a fire or explosion in a confined space as described herein. At block 820, in response to the detection of the event, the actuator 350 is activated thereby engaging the push rod 355 as described herein. At block 830, the push rod 355 is secured so that it does not retract, as described herein. In one embodiment, deformable material on both the poppet stem 335 and the push rod 355 secure the push rod 355. In another embodiment, the poppet stem 355 engages the groove 380, thereby securing the push rod 355. It can be appreciated that other systems and methods for securing the push rod 355 are contemplated in other embodiments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An automatic fire extinguisher (AFE) valve assembly, comprising:

a valve body;

a push rod defining an angled face and disposed in the valve body;

a poppet stem arranged perpendicular to a longitudinal axis of the push rod, disposed in the valve body and continuously contacting the angled face of the lush rod to in maintaining a closed position of the assembly, apply a continuous force to the push rod in a direction opposite a force applied to the push rod by an actuator of the automatic fire extinguisher;

a poppet-to-valve-body seal coupled to the poppet stem and disposed in the valve body; and a poppet-return spring coupled to the poppet stem and disposed in the valve body, wherein the push rod is configured to force the poppet stem toward a cylinder of the automatic fire extinguisher to open the poppet-to-valve-body seal for creating fluid communication between the cylinder and a main outlet of the assembly, allowing extinguishing agent from the cylinder to flow from the main outlet.

2. The assembly as claimed in claim 1 wherein the angled face includes a keyway.

3. The assembly as claimed in claim 2 wherein the poppet stem engages the keyway, and travels along the keyway upon actuation of the push rod.

4. The assembly as claimed in claim 3 wherein the poppet stem includes deformable material that secures the poppet stem to the push rod upon actuation of the push rod.

5. The assembly as claimed in claim 1 further comprising an end stop disposed in the valve body.

6. The assembly as claimed in claim 5 wherein the push rod includes deformable material that secures the push rod to the end stop upon actuation of the push rod.

7. The assembly as claimed in claim 3 wherein the push rod includes a groove configured to receive the poppet stem upon actuation of the push rod.

8. An automatic fire extinguisher (AFE) system, comprising:

a valve assembly;

a main outlet coupled to the valve assembly;

a cylinder defining an upwardly extending neck coupled to the valve assembly;

a refill valve coupled to the valve assembly for re-filling the cylinder with extinguishing agents; and an actuator coupled to the valve assembly and including a pin configured to be ejected a distance to push the valve assembly to actuate the valve assembly to place the valve assembly and the cylinder in fluid communication to allow the extinguishing agents to flow upwardly from the cylinder to the main outlet, wherein the valve assembly comprises:

a valve body;

a push rod defining an angled face and disposed in the valve body;

a poppet stem arranged perpendicular to a longitudinal axis of the push rod, disposed in the valve body, and continuously contacting the angled face of the push rod to, in maintaining a closed position of the valve assembly, apply a continuous force to the push rod in a direction opposite a force applied to the push rod by the pin of the actuator;

a poppet-to-valve-body seal coupled to the poppet stem and disposed in the valve body; and a poppet-return spring coupled to the poppet stem and disposed in the valve body, wherein the push rod is configured to force the poppet stem toward the cylinder to open the poppet-to-valve-body seal for creating the fluid communication.

9. The system as claimed in claim 8 wherein the angled face includes a keyway.

10. The system as claimed in claim 9 wherein the poppet stem engages the keyway, and travels along the keyway upon actuation of the push rod.

11. The system as claimed in claim 10 wherein the poppet stem includes deformable material that secures the poppet stem to the push rod upon actuation of the push rod.

12. The system as claimed in claim 8 further comprising an end stop disposed in the valve body.

13. The system as claimed in claim 12 wherein the push rod includes deformable material that secures the push rod to the end stop upon actuation of the push rod.

14. The system as claimed in claim 10 wherein the push rod includes a groove configured to receive the poppet stem upon actuation of the push rod.

15. A method for operating an automatic fire extinguisher (AFE), the method comprising:

detecting at least one of a fire or explosion in a confined space;

activating the automatic fire extinguisher that includes:

a valve assembly including:

a valve body;

an end stop disposed in the valve body;

a push rod having an angled face and keyway disposed in the angled face and disposed in the valve body;

a poppet stem arranged perpendicular to a longitudinal axis of the push rod, disposed in the valve body, and continuously contacting the angled face of the push rod to, in maintaining a closed position of the valve assembly, apply a continuous force to the push rod in a direction opposite a force applied to the push rod by an actuator of the automatic fire extinguisher;

a poppet-to-valve-body seal coupled to the poppet stem and disposed in the valve body; and a poppet-return spring coupled to the poppet stem and disposed in the valve body, wherein the push rod is configured to force the poppet stem toward a cylinder of the extinguisher coupled to the valve assembly to open the poppet-to-valve-body seal for creating fluid communication between the cylinder and a main outlet coupled to the valve assembly, allowing extinguishing agent from the cylinder to flow from the main outlet; and a refill valve coupled to the valve assembly, wherein the actuator is configured to place the valve assembly and the cylinder in fluid communication in response to the at least one of the fire and explosion event; and securing the push rod.

16. The method as claimed in claim 15 wherein the poppet stem includes deformable material that secures the poppet stem to the push rod upon actuation of the push rod, and wherein the push rod includes deformable material that secures the push rod to the end stop upon actuation of the push rod.

17. The method as claimed in claim 15 wherein the push rod includes a groove configured to receive the poppet stem upon actuation of the push rod, which secures the push rod to the poppet stem.

* * * * *